US007267427B2

(12) United States Patent
Miura et al.

(10) Patent No.: US 7,267,427 B2
(45) Date of Patent: Sep. 11, 2007

(54) METHOD OF MANUFACTURING INK JET HEAD AND INK JET HEAD

(75) Inventors: Hirotsuna Miura, Fujimi-machi (JP); Nobuko Watanabe, Kanazawa (JP)

(73) Assignee: Seiko Epson Corporation, Tokyo (JP)

( * ) Notice: Subject to any disclaimer, the term of this patent is extended or adjusted under 35 U.S.C. 154(b) by 144 days.

(21) Appl. No.: 10/889,069

(22) Filed: Jul. 13, 2004

(65) Prior Publication Data

US 2005/0024431 A1 Feb. 3, 2005

(30) Foreign Application Priority Data

Jul. 31, 2003 (JP) ..... 2003-284006

(51) Int. Cl.
*B41J 2/14* (2006.01)

(52) U.S. Cl. ..... 347/47

(58) Field of Classification Search ..... 347/20, 347/44, 47; 427/235; 430/320
See application file for complete search history.

(56) References Cited

U.S. PATENT DOCUMENTS 5,759,421 A * 6/1998 Takemoto et al. ..... 216/27
6,336,697 B1 1/2002 Fukushima
7,169,537 B2 * 1/2007 Miura et al. ..... 430/320

FOREIGN PATENT DOCUMENTS

| | | |
|---|---|---|
| JP | A-4-294145 | 10/1992 |
| JP | A-2000-290556 | 10/2000 |
| WO | WO99/38694 | 8/1999 |

* cited by examiner

*Primary Examiner*—An H. Do
(74) *Attorney, Agent, or Firm*—Oliff & Berridge PLC

(57) ABSTRACT

The present invention is intended to provide a method of manufacturing an ink jet head having good stable-ejection characteristics, and an ink jet head. The invention is an exemplary method of manufacturing an ink jet head having a cavity that contains liquid and a nozzle that communicates with the cavity, and ejecting the liquid contained in the cavity from an ejection orifice of the nozzle with using a nozzle opening at an opposite side of the cavity as the ejection orifice. The exemplary method includes making an ejection orifice on a side of the nozzle have a taper portion in which the diameter increases progressively toward the ejection orifice side and forming lyophobic films and lyophilic films alternately on the taper portion inside the nozzle so as to form a stack film, and forming a lyophobic film inside nozzle in which annular end surfaces of the lyophobic films and annular end surfaces of the lyophilic films are exposed alternately by grinding the stack film on the taper portion to expose a side section of the stack film.

9 Claims, 5 Drawing Sheets

METHOD OF MANUFACTURING INK JET HEAD AND INK JET HEAD

BACKGROUND OF THE INVENTION

1. Field of Invention

The present invention relates to a method of manufacturing an ink jet head used in an ink jet method in which droplets are ejected, and an ink jet head.

2. Description of Related Art

In a related art droplet ejecting method, a given amount of liquid material can be deposited to a desired position. An ink jet method, which is suitable for ejecting an especially small amount of liquid material, is an example of such a method.

An ink jet head used in the ink jet method includes a cavity containing liquid, and a nozzle plate in which nozzles communicating the cavity are formed. The ink jet head, using a nozzle opening at an opposite side of the cavity as an ejection orifice, ejects the liquid contained in the cavity from the ejection orifice.

In such an ink jet head, characteristics of contact with liquid in the vicinity of an ejection orifice of a nozzle especially, namely whether the vicinity of the ejection orifice is lyophobic or lyophilic, is an important factor for stably ejecting droplets composed of the liquid.

From the point of view of related art, an ink jet head in which a surface of a nozzle plate, at a side where the ejection orifice is formed, is treated with eutectoid plating. As such, the surface at the ejection orifice side and the vicinity of the ejection orifice inside a nozzle is lyophobic, as disclosed in Japanese Unexamined Patent Publication No. 4-294145.

Furthermore, as a technique in which attention is focused on whether lyophobic or lyophilic, a technique in which an ink-repellent film (a lyophobic film) is formed on a surface of a nozzle plate at a side the ejection orifice is formed, and, as liquid to be ejected, liquid whose receding dynamic contact angle is 15 degrees or more with respect to the ink-repellent film is used, as disclosed in Japanese Unexamined Patent Publication No. 2000-290556.

SUMMARY OF THE INVENTION

In both of the techniques in which eutectoid plating is implemented and the technique in which attention is focused on a receding dynamic contact angle with respect to an ink-repellent film, wetting of liquid on a surface of a nozzle plate at a side where the ejection orifice is formed is prevented, thereby preventing droplets to be ejected next from being unstably ejected because of wetting of the surface.

In view of stable ejection of droplets, especially enhancement of the stability of ejection amount, however, it has been insufficient for stable ejection to take into account only the wettability (lyophobicity or lyophilicity) of liquid on a surface of a nozzle plate at a side where nozzle ejection orifice is formed.

In view of the above and/or other problems, the present invention provides exemplary methods of manufacturing an ink jet head having good stable-ejection characteristics, and an ink jet head.

Between one ejection of a droplet and the next ejection, liquid contained in a cavity of a nozzle normally forms a meniscus in a nozzle. Namely, liquid is kept in a state where a tip of the meniscus thereof is located within a nozzle, and waits for the next ejection with the state. Accordingly, if the position of the tip of meniscus inside a nozzle is at the same position every time, stability of ejection amount is enhanced such that more favorable stable ejection can be implemented.

An exemplary method of manufacturing an ink jet head of one aspect of the present invention is an exemplary method of manufacturing an ink jet head having a cavity that contains liquid and a nozzle that communicates with the cavity, and ejecting the liquid contained in the cavity from an ejection orifice of the nozzle using a nozzle opening at an opposite side of the cavity as the ejection orifice. The exemplary method comprises making an ejection orifice side of the nozzle have a taper portion in which the diameter increases progressively toward the ejection orifice side. The exemplary method further comprises forming lyophobic films and lyophilic films alternately on the taper portion inside the nozzle so as to form a stack film and forming a lyophobic film inside the nozzle in which annular end surfaces of the lyophobic films and annular end surfaces of the lyophilic films are exposed alternately by grinding the stack film on the taper portion so as to expose a side section of the stack film.

According to the exemplary method of manufacturing an ink jet head, a lyophobic film inside the nozzle in which annular end surfaces of lyophobic films and annular end surfaces of lyophilic films are alternately exposed is formed at an ejection orifice side of the nozzle. As such, the difference between receding contact angle and advancing contact angel is large on the lyophobic film inside nozzle. The obtained ink jet head therefore, shows good stable-ejection characteristics due to the lyophobic film inside nozzle. Namely, when an end of meniscus of liquid moves on the lyophobic film inside the nozzle, since the difference between receding contact angle and advancing contact angle of the lyophobic film inside the nozzle with respect to the liquid is large, the tip of meniscus is easier to remain at a given position (initial position) on the lyophobic film inside the nozzle compared to the case where the difference is small. Thus, the position of the tip of meniscus becomes almost same position every time, such that stability of ejection amount is enhanced.

In the exemplary method of manufacturing an ink jet head, grinding of the stack film on the taper portion is preferably implemented by threading a column-shaped bar with an outside diameter slightly smaller than desired nozzle diameter into the nozzle so as to grind and polish the stack film.

According to this exemplary method, an end of the stack film on the taper portion is grinded and polished obliquely with the bar, and thereby the stack film has a structure in which each end surface of the lyophobic film and lyophilic film is exposed to the inside of the nozzle. In the obtained lyophobic film inside the nozzle, therefore, annular lyophobic portions and annular lyophilic portions are located alternately.

In the exemplary method of manufacturing an ink jet head, the nozzle is preferably formed in a nozzle plate. In forming the lyophobic films and the lyophilic films alternately so as to form the stack film, the same stack film is preferably also formed on an outer surface side of the nozzle plate, and an outermost layer of the stack film is preferably a lyophobic film.

According to this exemplary embodiment, a lyophobic film is formed on an outer surface of the nozzle plate simultaneously with forming of the stack film.

In the exemplary method of manufacturing an ink jet head, each of the lyophobic films is preferably composed of silicone resin. Accordingly, each of the lyophobic films is preferably a plasma-polymerized film formed by plasma-polymerizing silicone resin. This enables the lyophobicity of the lyophobic film to be changed favorably.

In the exemplary method of manufacturing an ink jet head, each of the lyophilic films is preferably formed by applying energy to a lyophobic film so as to change the lyophobic film into lyophilic. Accordingly, where each of the lyophobic films is composed of silicone resin especially, each of the lyophilic films is preferably formed by irradiating a lyophobic film with light so as to change the lyophobic film into lyophilic.

According to this exemplary method, it becomes easy to change the lyophobicity of the lyophobic film so as to make the film lyophilic.

An ink jet head of another exemplary embodiment of the present invention comprises a lyophobic film inside the nozzle in which annular lyophobic portions and annular lyophilic portions are located alternately and formed in the vicinity of an ejection orifice on an inner wall of a nozzle.

According to the ink jet head, the lyophobic film inside nozzle is formed so that annular lyophobic portions and annular lyophilic portions are located alternately such that the difference between receding contact angle and advancing contact angle of the lyophobic film inside nozzle is large. Thus the lyophobic film inside nozzle allows good stable-ejection characteristics to be shown.

In the ink jet head according to the exemplary embodiment, the nozzle is preferably formed in a nozzle plate. A lyophobic film is preferably provided on an outermost surface at an outer surface side of the nozzle plate.

This enables the wetting of liquid at an outer surface side of the nozzle plate to be reduced or prevented because of the lyophobic film. Thus, unstable ejection can be reduced or prevented because of the wetting of the nozzle plate.

DETAILED DESCRIPTION OF PREFERRED EMBODIMENTS

An exemplary method of manufacturing an ink jet head of the present invention, and an ink jet head obtained through the exemplary method will be described in detail below.

Figure 1A:
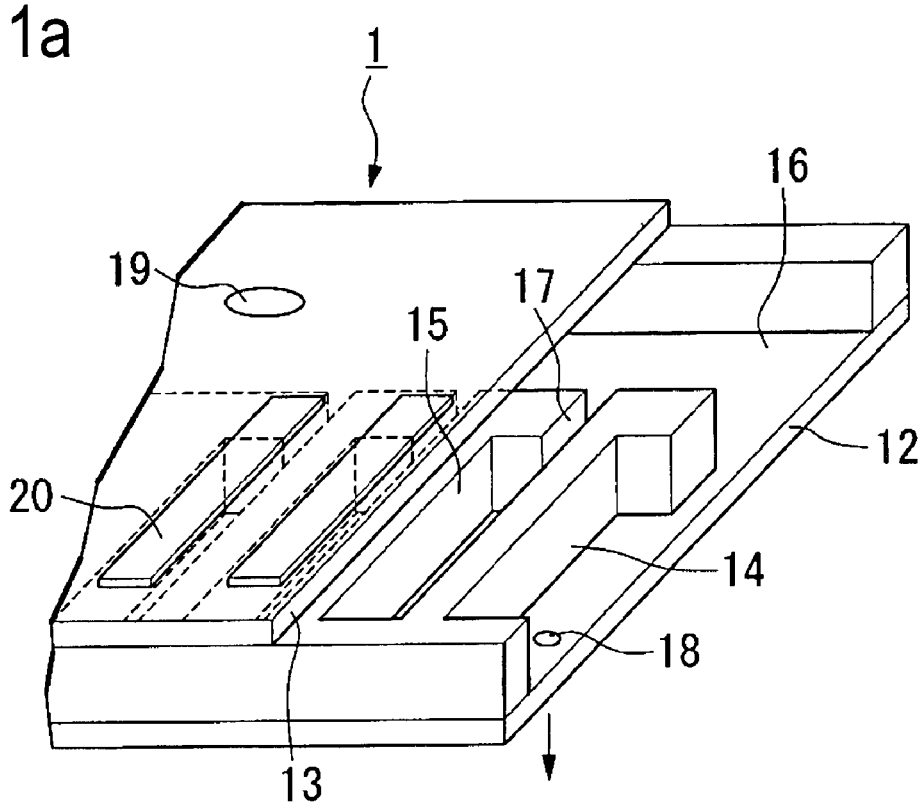
FIGS. 1*a* and *b* are schematic structural diagrams that show an ink jet head.

FIGS. 1*a* and *b* are diagrams for illustrating a schematic structure of an ink jet head applying the exemplary manufacturing method of the present invention. Numeral 1 indicates an ink jet head in FIGS. 1*a* and *b*. In the ink jet head 1, as shown in FIG. 1*a*, a nozzle plate 12 composed of stainless, for example, stainless steel and a diaphragm 13 are included, and the both are bonded to each other with a partition member (reservoir plate) 14 therebetween. Between the nozzle plate 12 and the diaphragm 13, a plurality of cavities 15 and a reservoir 16 are formed by the partition member 14. The cavities 15 and the reservoir 16 are communicated with each other with a flow channel 17 therebetween.

The insides of each of the cavities 15 and the reservoir 16 are filled with liquid, and the liquid is contained therein. The flow channel 17 therebetween functions as a supply port that supplies liquid from the reservoir 16 to the cavity 15. In the nozzle plate 12, a plurality of nozzles 18 of a hole shape for ejecting liquid from the cavity 15 is formed in a manner being arranged vertically and horizontally. The shape of the nozzle 18 at a cavity 15 side is a taper shape, and the diameter thereof increases progressively toward the cavity 15 side. An opening at an opposite side of the cavity 15 is an ejection orifice 9 for ejecting droplets. In the nozzle plate 12, a lyophobic film 10 is formed on a surface in which the ejection orifice 9 is formed. The lyophobic film 10 is formed in a manner surrounding the vicinity of the ejection orifice 9, which is on an inner wall of the nozzle 18.

An opening 19 leading into the reservoir 16 is formed in the diaphragm 13. A tank (not shown in the drawing) filled with liquid is coupled to the opening 19 with a tube (not shown in the drawing) therebetween.

Figure 1B:
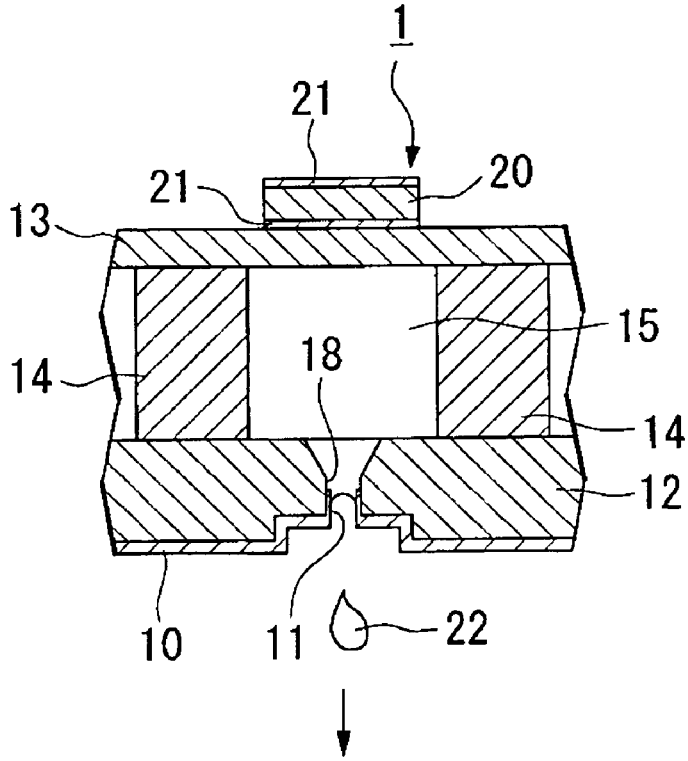

Bonded onto a surface of the diaphragm 13 at an opposite side of a surface facing the cavity 15, is a piezoelectric element (a piezo element) 20 as shown in FIG. 1*b*. The piezoelectric element 20 functions as an ejection means in the ink jet head 1, and is interposed between a couple of electrodes 21 so as to be bent in a manner of protruding outside by energization.

The diaphragm 13 to which the piezoelectric element 20 is bonded with such a structure is bent outward simultaneously and integrally therewith when the piezoelectric element 20 is bent, thereby increasing the volume of the cavity 15. Then, in the case where the cavity 15 communicates with the reservoir 16 and the reservoir 16 is filled with liquid, liquid of an amount corresponding to the increased volume in the cavity 15 flows from the reservoir 16 via the flow channel 17.

Then, when energization for the piezoelectric element 20 is removed at such a state, the piezoelectric element 20 and the diaphragm 13 revert to their original shape. Thus, the cavity 15 also reverts to its original volume such that the pressure of liquid inside the cavity 15 rises, and thereby liquid droplets 22 are ejected from the ejection orifice 9 of the nozzle 18.

As an ejection means of the ink jet head 1, a method other than an electromechanical transducer using the piezoelectric element (piezo element) 20 may be available. For example, an exemplary method in which an electrothermal transducer is used as an energy generating element, continuous methods such as a charge control type and a pressure vibration type, an electrostatic suction method, and a method in which electromagnetic wave such as laser is emitted to generate heat so as to eject liquid by utilizing the operation of the heat generation, may be adopted.

Figure 2:
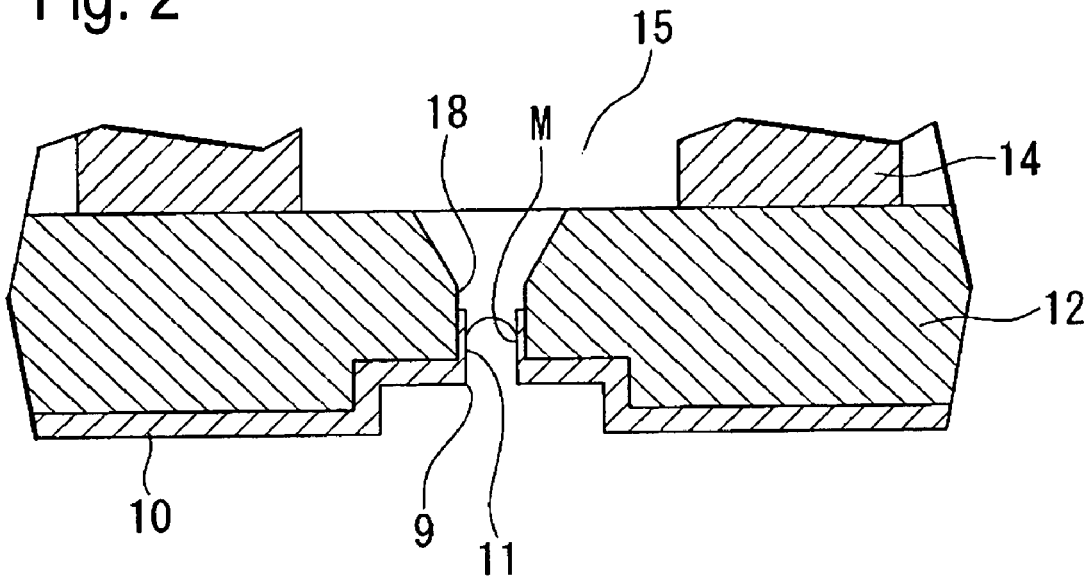
FIG. 2 is a magnified schematic that shows a significant part of a nozzle plate.

In the ink jet head 1 having such a structure, on the nozzle plate 12, the lyophobic film 10 is formed on a surface in which the ejection orifice 9 is formed and the vicinity of the ejection orifice 9, which is on an inner wall of the nozzle 18. In the lyophobic film 10, a portion formed in the vicinity of the ejection orifice 9 on an inner wall of the nozzle 18 is a lyophobic film 11 inside nozzle especially as shown in FIG. 2. In the lyophobic film 11 inside nozzle, the difference between a receding contact angle and an advancing contact angle with respect to ejected liquid, is large. Specifically, the advancing contact angle is equal to or greater than 50 degrees, and equal to or smaller than 90 degrees. The receding contact angle is smaller than 25 degrees, and so the difference between both angles is equal to or greater than 25 degrees.

The ink jet head 11 therefore shows good stable-ejection characteristics due to the lyophobic film 11 inside the nozzle. Namely, inside the nozzle 18, when a tip of meniscus M moves on the lyophobic film 11 inside the nozzle in order to prepare for the next ejection after one ejecting action is finished. That is, since the difference between the receding contact angle and advancing contact angle of the lyophobic film 11 inside the nozzle with respect to the liquid is large, the tip of meniscus M is easier to remain at a given position (initial position) on the lyophobic film 11 inside the nozzle. Thus, the position of the tip of meniscus M becomes almost same position every time such that stability of ejection amount is enhanced.

Here, the receding contact angle and advancing contact angle of the lyophobic film 11 inside the nozzle (solid sample) with respect to ejected liquid (liquid sample) are referred to as a dynamic contact angle. As a measurement method thereof in related art, for example, (1) Wilhelmy method, (2) expansion-contraction method, (3) drop method, and so on are used. In the following exemplary measurement methods, a sample in which the same lyophobic film as the lyophobic film 11 inside the nozzle formed on a stainless plate, is used as a solid sample.

(1) The related art Wilhelmy method is a method in which the load in the process of dipping a solid sample into liquid sample in a sample tank and the load in the process of pulling up the dipped sample are measured, and then a dynamic contact angle is determined from the measured value and the value of surface area of the solid sample. The contact angle obtained in the process of dipping the solid sample is an advancing contact angle, and that obtained in the process of pulling up, is a receding contact angle.

(2) The related art expansion-contraction method is a method in which an advancing contact angle is obtained by measuring the contact angle between a surface of a solid sample and a droplet while pushing out liquid sample at a constant flow rate onto the surface of the solid sample from a tip of a needle, glass capillary tube, and the like. Meanwhile, a receding contact angle is obtained by measuring the contact angle between a surface of a solid sample and a droplet while drawing a liquid sample, forming a droplet, from a tip of a needle, glass capillary tube, and the like.

(3) The related art drop method is a method in which a droplet is formed on a solid sample and then the contact angle between a solid sample and a droplet is measured while inclining the solid sample or making it vertical. The contact angle at a front side of a moving direction of liquid is an advancing contact angle, and the contact angle at a back side is a receding contact angle.

The above related art measurement methods, however, involve difficulties that a measurable sample is limited, and so on. Thus, in the present exemplary embodiment, the following method, which is a modification of the above (2) expansion-contraction method, is used.

Figure 3A:
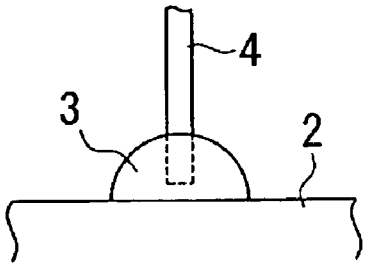
FIGS. 3*a* and *b* are explanatory schematic diagrams that show a measurement method of a dynamic contact angle.
Figure 3B:
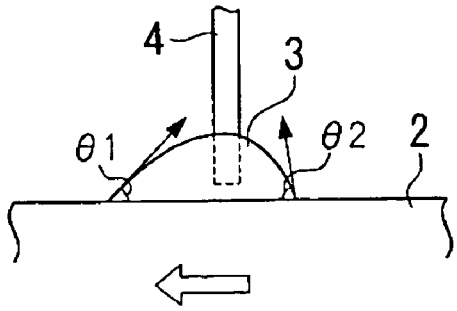

As shown in FIG. 3*a*, in a state where a tip of a needle-like tube 4 is inserted into a droplet 3 formed on a surface of a solid sample 2, the solid sample 2 is moved in a horizontal direction. Then, since the needle-like tube 4 is inserted into the droplet 3, the droplet 3 is deformed from being dragged by the needle-like tube 4 along with moving of the solid sample 2 because of interfacial tension between the droplet 3 and the needle-like tube 4, as shown in FIG. 3*b*.

Since the magnitude of contact angle between the solid sample 2 and the droplet 3 at the state where the droplet 3 is thus deformed, depends on the surface tension of liquid constituting the droplet 3, surface tension of a solid constituting the solid sample 2, interfacial tension between liquid and solid, frictional force, absorptivity, roughness of solid surface, and so on, a dynamic contact angle can be obtained by measuring a contact angle in this state. Namely, a receding contact angle is obtained from a contact angle θ1 at a front side of moving direction of the solid sample 2, and an advancing contact angle is obtained from a contact angle θ2 at a back side.

In such an exemplary measurement method, by moving the solid state 2 in a horizontal direction, where a tip of a needle-like tube is inserted into a droplet on the solid sample 2, only a dynamic contact angle, which results from the above factors such as surface energy, frictional force, and so on, can be measured without investigating the factors, and measurement of a dynamic contact angle can be implemented appropriately with respect to all kinds of solid samples and liquid samples. In the present exemplary embodiment, therefore, the measurement method shown in FIG. 3 is adopted as a method of measuring advancing and receding contact angles. Meanwhile, in the invention, a measurement method other than the measurement method shown in FIG. 3, for example, the methods shown in the above (1) through (3) may be adopted of course. In this exemplary embodiment, the difference in a dynamic contact angle (advancing contact angle and receding contact angle) may be caused between the measurement methods because of the difference of a measurement device (instrumental error) and so on. In the case of using a measurement method other than the measurement method shown in FIG. 3, therefore, it is preferable that, with correlating the measurement method with the method shown in FIG. 3 previously, the actually measured value (dynamic contact angle) is converted into the value (dynamic contact angle) obtained through the measurement method shown in FIG. 3, and is used.

Next, based on a forming method of the lyophobic film 11 inside nozzle show in FIG. 2, exemplary embodiments of a method of manufacturing an ink jet head and an ink jet head of the present invention will be described.

Figure 4A:
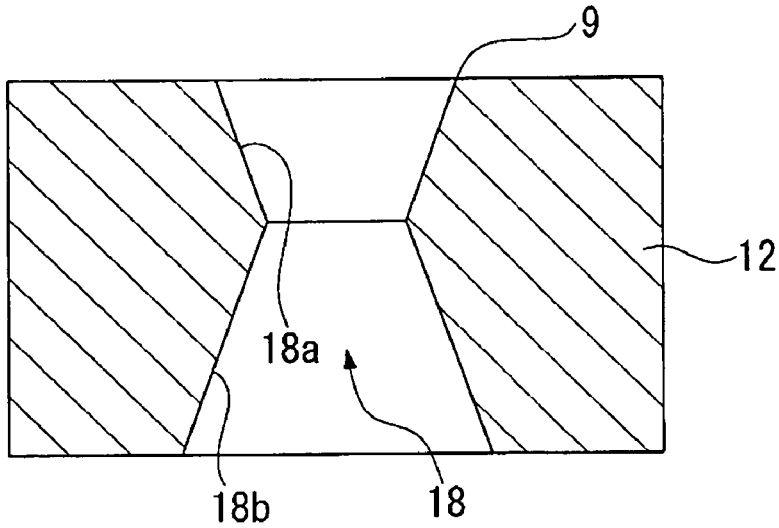
FIGS. 4*a* through *c* are explanatory schematic diagrams that show a manufacturing method of an ink jet head.

In the present exemplary embodiment, the nozzle plate 12 in which the nozzles 18 are formed is prepared first. With respect to the nozzles 18 of the nozzle plate 12, as shown in FIG. 4*a*, the shape at an ejection orifice 9 side is made to be a taper-shape, while the shape at an opposite side of the ejection orifice 9 (cavity 15 side) is also made to be a taper-shape.

Namely, with respect to the ejection orifice 9 side, a taper portion 18*a* in which the diameter increases progressively toward the ejection orifice 9 side, is formed. Meanwhile, with respect to an opposite side of the ejection orifice 9 (cavity 15 side), a diameter of a taper portion 18*b* increases progressively toward the cavity 15 side. In the taper portion 18*a* at the ejection orifice 9 side, the inclination angle of the inner surface, namely the inclination angle with respect to the center axis of the nozzle 18, is set to be about from 5 degrees to 15 degrees for example, and is preferably set to be about 6 degrees. Meanwhile, the inclination angle of the cavity 15 side is not specifically limited, and is set to be at an any angle, for example set to be about from 5 degrees to 15 degrees.

To form taper portions 18*a* and 18*b*, an exemplary method includes a bar having a taper surface corresponding to an angle to be set, that is, a bar having a cone-shaped tip portion is prepared, and the bar is rotated while opposed to one surface side of the nozzle plate 12 so as to grind the nozzle plate 12 to a given depth while polishing the inner surface thereof. Here, in the polishing, alumina fine particles, whose average particle diameter is about 0.5 μm, is used as an abrasive, and the polishing is implemented with a state where the abrasive is provided between the nozzle plate 12 and the bar. In the nozzle 18, in order to set the inside diameter at the ejection orifice 9 side be 25 μm, for example, the inside diameter of the part whose diameter is smallest of the taper portion 18*a*, is set to be about 25 μm.

Figure 4B:
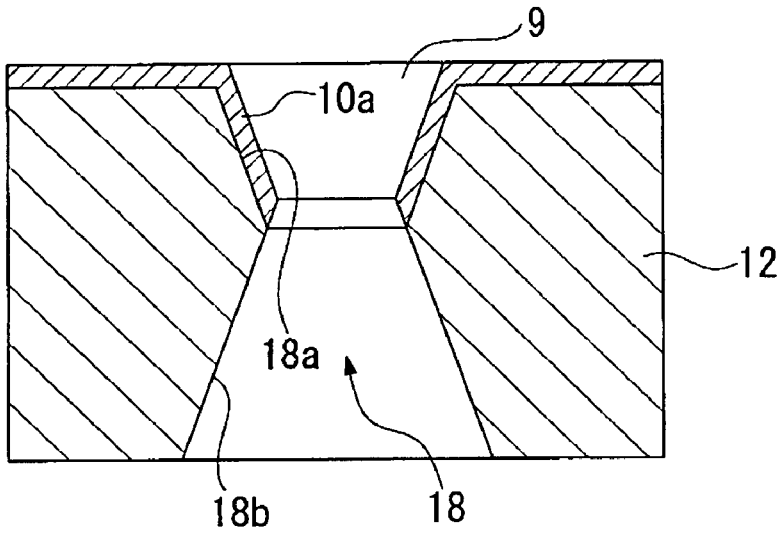

Subsequently, silicone resin is plasma-polymerized on a surface of the nozzle plate 12 in which the ejection orifice 9 is formed, so as to form a plasma-polymerized film with the thickness of about 50 nm on a surface in which the ejection orifice 9 is formed. The plasma-polymerized film is formed in a manner of surrounding the taper portion 18*a* easily since the ejection orifice 9 side of the nozzle 18 is the taper portion 18*a* in which the diameter progressively increases outward, such that the plasma-polymerized film is also formed on the taper portion 18*a* on an inner wall of the nozzle 18, as shown in FIG. 4*b*.

The film thickness of the plasma-polymerized film, formed on an inner wall of the nozzle 18, is almost the same thickness as the film thickness of the plasma-polymerized film formed on a surface of the nozzle plate 12 in which the ejection orifice 9 is formed, namely about 50 nm.

When plasma-polymerization is implemented in this way, an obtained plasma-polymerized film has a main chain comprising —Si—O—Si— coupling, and including a carbon containing group such as an alkyl group and allyl group as a side chain, so as to be a film having lyophobicity (hydrophobicity), namely a lyophobic film 10*a*.

After the lyophobic film 10*a*, formed of a plasma-polymerized film, is formed on a surface in which the ejection orifice 9 is formed and the taper portion 18*a* in the nozzle 18, excimer laser light (wavelength; 174 nm), which is ultraviolet laser light, is radiated along an axis direction of the nozzle 18 from a lyophobic film 10*a* side, namely an ejection orifice 9 side, of the nozzle plate 12 under oxygen-existing atmosphere (in the present exemplary embodiment, atmosphere in which oxygen is slightly added to nitrogen is used since oxygen absorbs ultraviolet light so as to generate ozone).

Figure 4C:
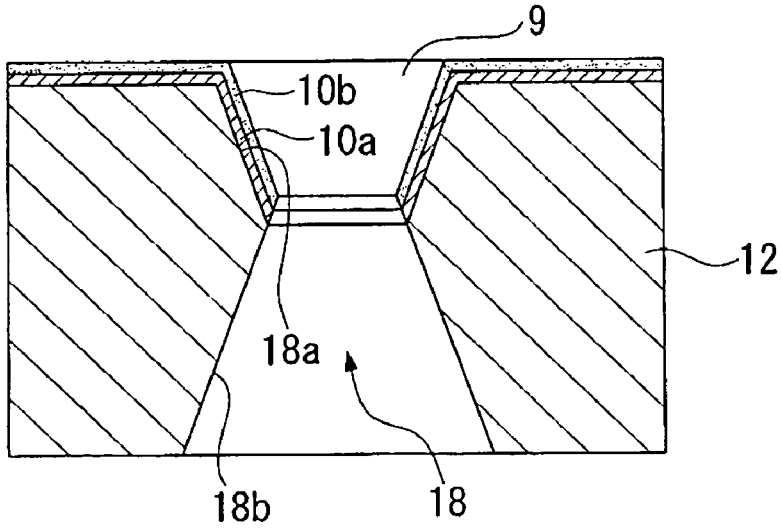

Then, the plasma-polymerized film (lyophobic film 10*a*) is exposed with excimer laser light inside the nozzle 18. When exposure is thus implemented, at an exposed portion, an alkyl group and allyl group, which are side chains in a plasma-polymerized film formed of silicone resin, are broken by excimer laser light. Finally $SiO_2$, which is hydrophilic (lyophilic), is formed through incorporating oxygen in the atmosphere and so on, such that a lyophilic film 10*b* is formed, as shown in FIG. 4*c*. Here, in the exposure with excimer laser light, instead of exposing the whole plasma-polymerized film (lyophobic film 10*a*), namely to the whole thickness, an amount of radiated light and radiation time are controlled so that only about half of the film thickness at a surface side is exposed but the inner layer side thereof is not exposed. For example, by radiating with light amount of 5 $mW/cm^2$ and radiation time of three minutes, about half at a surface side can be exposed without exposing the inner layer side.

By exposing under such condition, in the plasma-polymerized film, the inner layer side is not exposed so as to remain as the lyophobic film 10*a*, and the surface side is made be lyophilic so as to become the lyophilic film 10*b* as shown in FIG. 4*c*.

Figure 5A:
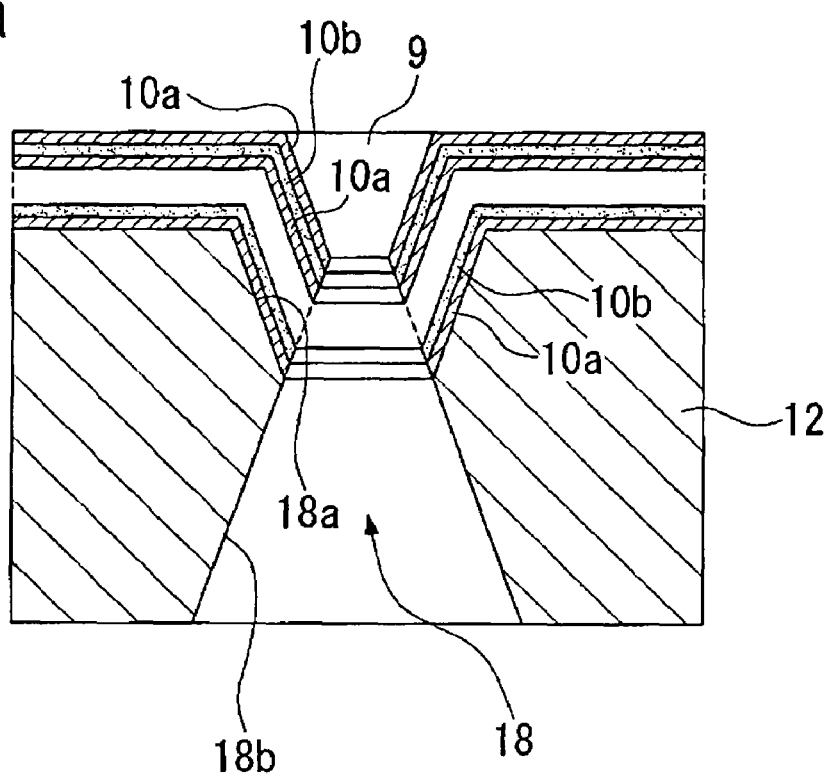
FIGS. 5*a* and *b* are explanatory schematic diagrams that show a manufacturing method subsequent to FIG. 4.

Furthermore, such a forming (film depositing) process of a plasma-polymerized film and an exposing process for only a surface side of the formed plasma-polymerized film are repeated sequentially ten times, for example. Thereby, as shown in FIG. 5*a*, a stack film 11*a* whose thickness is about 500 nm, formed of the lyophobic films 10*a* and the lyophilic films 10*b* is formed on a surface of the nozzle plate 12 in which the ejection orifice 9 is formed and the taper portion 18*a* in the nozzle 18. If the stack film 11*a* is thus formed, on the taper portion 18*a* in the nozzle 18, each film is sequentially deposited on an inclined surface (taper surface) of the taper portion 18*a* such that the stack film 11*a* is deposited obliquely to the center axis of the nozzle 18 in a manner of extending the taper surface of the taper portion 18*a* as it is. The stack film 11*a* therefore narrows the inside diameter of the nozzle 18 at the interior side thereof (an opposite side of the ejection orifice 9).

In such forming of the stack film 11*a*, a film which is an outermost layer is preferably the lyophobic film 10*a*, namely an outermost film is preferably left as it is without exposing it after forming of a plasma-polymerized film. This allows the lyophobic film 10*a* to function as the lyophobic film 10 on a surface of the nozzle plate 12 in which the ejection orifice 9 is formed as shown in FIG. 2. Thus, the lyophobic film 10 can be formed simultaneously with the formation of the stack film 11*a*.

After the stack film 11*a* is formed by threading a bar into the nozzle 18 from the ejection orifice 9 side, part of the stack film 11*a* is grinded so as to expose the side section thereof, while the exposed section is polished. As a bar threaded into the nozzle 18, unlike in the case of forming the taper portion 18 (18*b*), a column-shaped bar whose tip side does not have a taper surface is used. In addition, the outside diameter of the bar is set to be slightly smaller than the inside diameter at the ejection orifice 9 side of the nozzle 18 formed finally, namely desired nozzle diameter. In partially grinding of the stack film 11*a* and polishing thereof with such a bar, the above abrasive composed of almina fine particles is used, when polishing.

Figure 5B:
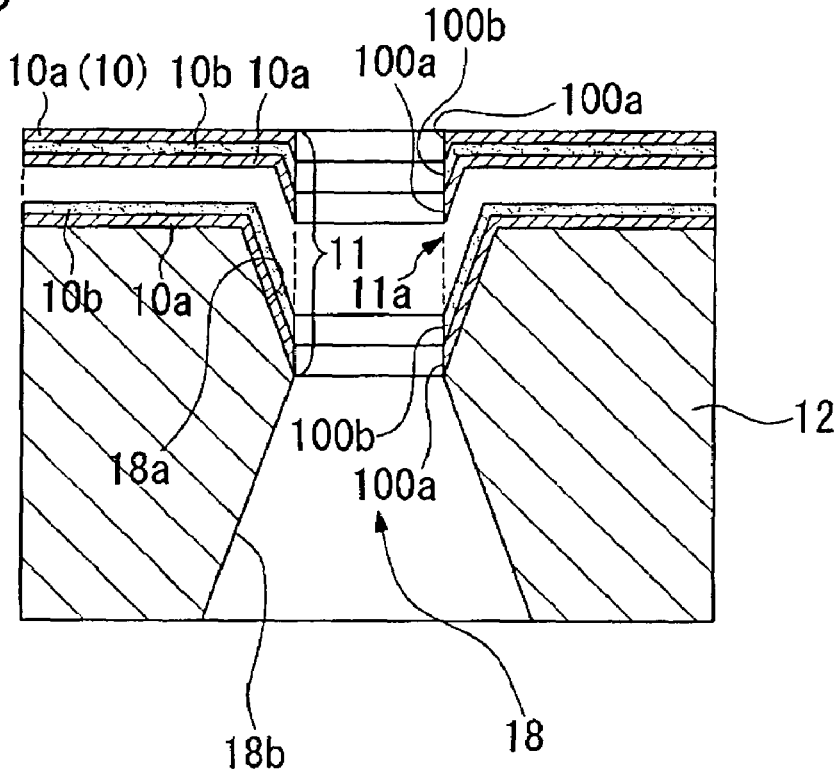

Then, since the stack film 11*a* on the taper portion 18*a* is formed in a manner of being stacked obliquely to the center axis of the nozzle 18 as described, the edge side of the stack film 11*a* is grinded and polished obliquely as shown in FIG. 5*b* by threading a bar along the center axis of the nozzle 18. Furthermore, when grinded and polished obliquely, the stack film 11*a* exposes each surface of the lyophobic films 10*a* and the lyophilic films 10*a* in the nozzle 18. Thereby, each end surface of the stack film 11*a* is located alternatively so as to form the lyophobic film 11 inside nozzle. Namely, through such grinding and polishing, each end surface of the lyophobic film 10*a* and the lyophilic film 10*a* becomes a lyophobic portion 100*a* and a lyophilic portion 100*b*, respectively. The portions are formed in a annular shape along a circumferential direction on a circumferential surface of the taper portion 18*a*, and are formed alternatively with about 0.5 μm pitch.

If the lyophobic portions 100*a* and the lyophilic portions 100*b* of an annular shape are formed alternately, on the lyophobic film 11 inside nozzle constituted with the lyophobic portions 100*a* and the lyophilic portions 100*b*, an advancing contact angle with respect to liquid becomes relatively large and a receding contact angle becomes small. Namely, if the lyophobic portions 100*a* and the lyophilic portions 100*b* exist alternately, when liquid moves in the nozzle 18 at the advancing side, an advancing contact angle has a tendency to become large since the liquid remains mainly on the lyophobic portion 100*a* while the liquid moves on the lyophilic portion 100*b* between the lyophobic portions 100*a* instantaneously. Meanwhile, at the receding side, a receding contact angel has a tendency to become small since the liquid is dragged by the lyophilic portion 100*b*.

The ink jet head obtained by forming the lyophobic film 11 inside the nozzle therefore shows good stable-ejection characteristics due to the lyophobic film 11 inside the nozzle. Namely, when an end of meniscus of liquid moves on the lyophobic film 11 inside the nozzle, since the difference between a receding contact angle and advancing contact angle of the lyophobic film 11 inside the nozzle with respect to the liquid is large, the tip of meniscus is easier to remain at a given position (initial position) on the lyophobic film 11 inside the nozzle compared to the case where the difference is small. Thus, the position of the tip of meniscus becomes almost the same position every time such that good stable-ejection characteristics is shown and stability of ejection amount is enhanced.

Here, it should be understood that the present invention is not limited to the above exemplary embodiments but apply to various kinds of modifications without departing from the scope and spirit of the present invention. For example, in the above exemplary embodiment, a plasma-polymerized film is formed as the lyophobic film 10*a*, and thereafter the half of film thickness is exposed so as to turn only the surface layer portion into the lyophilic film 10*b*. Alternatively, after the lyophobic film 10*a* is formed, a plasma-polymerized film (the lyophobic film 10*a*) may be formed thereon once again and then exposure may be implemented with controlling condition so that only the plasma-polymerized film formed later is exposed, so as to form the lyophilic film 10*b* on the lyophobic film 10*a*.

In addition, the angle of the taper portion 18*a* in the nozzle 18, the number of stacks of each film in the stack film 11*a*, the thickness of each film, and so on, can also be set arbitrarily without being limited to the above exemplary embodiments. This enables the pitch of the lyophobic portion 100*a* and the lyophilic portion 100*b* to be determined arbitrarily.

Figure 6:
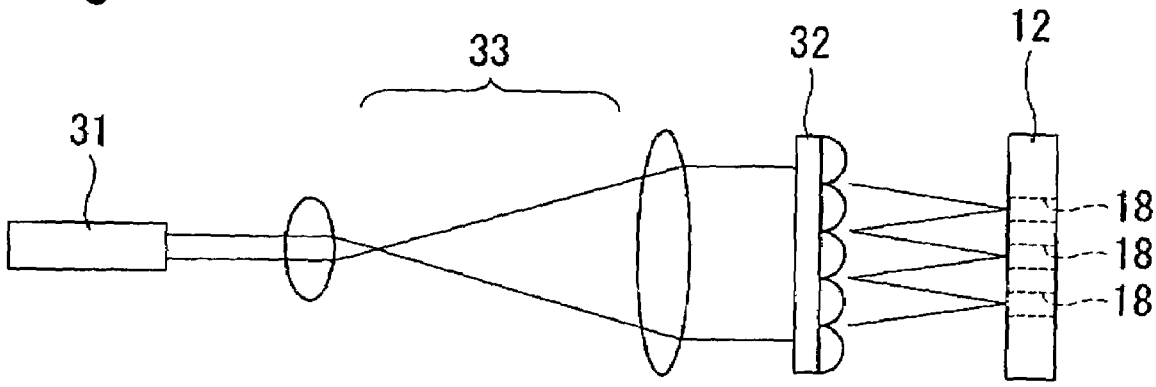
FIG. 6 is a schematic that shows an exemplary modification of an embodiment of the present invention.

Meanwhile, when laser light is emitted into the nozzle 18 of the nozzle plate 12, a lens array (condenser lens) 32 may be provided between a laser light source 31 and the nozzle plate 12 as shown in FIG. 6, and laser light may be condensed into the nozzle 18 of the nozzle plate 12 with the lens array 32. Namely, parallel light may be let in the lens array 32 from the laser light source 31 through an optical lens system 33, and the light may be focused into each of the nozzles 18 of the nozzle plate 12 with utilizing the lens array 32.

According to this exemplary embodiment, by focusing laser light into the nozzle 18 with the lens array 32, exposure efficiency is enhanced such that exposure time can be shortened or the degree of exposure can be enhanced.

What is claimed is:

1. A method of manufacturing an ink jet head, the ink jet head having a cavity that contains liquid and a nozzle that communicates with the cavity, and ejecting the liquid contained in the cavity from an ejection orifice of the nozzle with using a nozzle opening at an opposite side of the cavity as the ejection orifice, the method comprising:

making an ejection orifice side of the nozzle have a taper portion in which a diameter increases progressively toward the ejection orifice side;

forming lyophobic films and lyophilic films alternately on the taper portion inside the nozzle so as to form a stack film; and forming a lyophobic film inside the nozzle in which annular end surfaces of the lyophobic films and annular end surfaces of the lyophilic films are exposed alternately by grinding the stack film on the taper portion so as to expose a side section of the stack film.

2. The method of manufacturing an ink jet head according to claim 1, the grinding of the stack film on the taper portion including threading a column-shaped bar having an outside diameter that is slightly smaller than a desired nozzle diameter into the nozzle so as to grind and polish the stack film.

3. The method of manufacturing an ink jet head according to claim 1, further including forming the nozzle in a nozzle plate; and forming the lyophobic films and the lyophilic films alternately so as to form the stack film, forming the same stack film on an outer surface side of the nozzle plate, an outermost layer of the stack film being a lyophobic film.

4. The method of manufacturing an ink jet head according to claim 1, each of the lyophobic films being composed of silicone resin.

5. The method of manufacturing an ink jet head according to claim 4, each of the lyophobic films being a plasma-polymerized film formed by plasma-polymerizing silicone resin.

6. The method of manufacturing an ink jet head according to claim 1, each of the lyophilic films being formed by applying energy to a lyophobic film so as to change the lyophobic film into being lyophilic.

7. The method of manufacturing an ink jet head according to claim 4, each of the lyophilic films being formed by irradiating a lyophobic film with light to change the lyophobic film into being lyophilic.

8. An ink jet head, comprising:

a nozzle; and a lyophobic film inside the nozzle, the lyophobic film having annular lyophobic portions and annular lyophilic portions located alternately, and the lyophobic film formed in a vicinity of an ejection orifice on an inner wall of the nozzle, wherein annular end surfaces of the lyophobic and lyophilic portions are exposed.

9. The ink jet head according to claim 8, further comprising:

a nozzle plate;

the nozzle being formed in the nozzle plate; and a lyophobic film on an outermost surface at an outer surface side of the nozzle plate.

* * * * *